US006077047A

United States Patent [19]

Nagai et al.

[11] Patent Number: 6,077,047

[45] Date of Patent: Jun. 20, 2000

[54] VARIABLE DISPLACEMENT COMPRESSOR

[75] Inventors: Hiroyuki Nagai; Masahiro Kawaguchi; Masanori Sonobe; Ken Suitou; Takuya Okuno; Koji Kawamura, all of Kariya, Japan

[73] Assignee: Kabushiki Kaisha Toyoda Jidoshokki Seisakusho, Aichi-ken, Japan

[21] Appl. No.: 09/012,696

[22] Filed: Jan. 23, 1998

[30] Foreign Application Priority Data

Jan. 24, 1997 [JP] Japan ..... 9-011200
Mar. 31, 1997 [JP] Japan ..... 9-080501

[51] Int. Cl.[7] ..... F04B 1/26

[52] U.S. Cl. ..... 417/222.1; 417/269

[58] Field of Search ..... 417/222.1, 269

[56] References Cited

U.S. PATENT DOCUMENTS 5,056,416 10/1991 Ota et al. .
5,915,928 6/1999 Murase et al. ..... 417/269

FOREIGN PATENT DOCUMENTS 0 301 519A2 2/1989 European Pat. Off. .
0 340 024A1 11/1989 European Pat. Off. .
0 750 115A1 12/1996 European Pat. Off. .
748 937A2 12/1996 European Pat. Off. .
8159022 6/1996 Japan .

*Primary Examiner*—Timothy S. Thorpe
*Assistant Examiner*—Ehud Gartenberg
*Attorney, Agent, or Firm*—Morgan & Finnegan, L.L.P.

[57] ABSTRACT

A variable displacement type compressor is disclosed. The compressor includes a housing, a cylinder bore within the housing, a piston located in the cylinder bore, a drive shaft rotatably supported by the housing, a rotary support mounted on the drive shaft, and a cam plate connected to the piston. The cam plate is supported tiltably on the drive shaft and is slidable in axial directions of the drive shaft. The cam plate inclines between a maximum inclination position and a minimum inclination position when the displacement of the compressor is changed. A first moment is applied to the cam plate by a compression reaction force of the piston when the compressor is operating. A hinge mechanism is located between the rotary support and the cam plate. The cam plate is rotated integrally with the drive shaft, the rotary support, and the hinge mechanism. An urging device is located between the rotary support and the cam plate for urging the cam plate toward the minimum go inclination angle position An applying mechanism applies a second moment to the swash plate in the same direction as the first moment when the compressor is not operating.

20 Claims, 12 Drawing Sheets

37
36
31
48
29
28
50
12
M1
M2
23c
23b
38
64
K1
T
35
M2
M1
23d
26a
26
24
25
27
65
23a
23
25a
22a
22
46
16
11
23b
T
35
23a
23
68a
K11
K1
64
68
48
65
H
26a
26
23
25a
24
25
22

37
36
50
12
M2
M1
23c
35
23b
29
M1
M2
23d
64
K
T
65
23
26
25a
24
25
27
22
26a
16
25a
26
24
26a
25
22
23b
T
35
23
65
K
64
27
H 12
11
16
22
22a
23
23a
23b
23c
23d
24
25
25a
26
26a
27
27a
27b
27c
27d
28
29
31
35
36
37
38
46
48
50
64
65
68b
K
T
H
M1
M2
M3

VARIABLE DISPLACEMENT COMPRESSOR

BACKGROUND OF THE INVENTION

The present invention relates to variable displacement compressors that are employed in air-conditioning systems for automotive vehicles. More particularly, the present invention pertains to a variable displacment compressor that employs an inclinable cam plate to adjust displacement.

A clutchless-type variable displacement compressor is shown in FIGS. 10 to 12. As shown in these drawings, a housing 105 houses cylinder bores 101, a crank chamber 102, a suction chamber 103, and a discharge chamber 104. A drive shaft 107 extending through the crank chamber 102 is rotatably supported in the housing 105. A rotor 108 is fixed to the drive shaft 107 in the crank chamber 102. A swash plate 109 is accommodated in the crank chamber 102. The swash plate 109 is supported by the drive shaft 107 in a manner such that it is slidable and inclinable with respect to the drive shaft 107. Pistons 106 are coupled to the swash plate 109. Support arms 111 extend from the rotor 108 while associated guide pins 112 project from the swash plate 109. The support arms 111 and the guide pins 112 constitute a hinge mechanism 110. Each guide pin 112 has a spherical portion 112*a*, which is slidably fitted into a guide bore 111*a* extending through the associated support arm 111.

Accordingly, the swash plate 109 rotates integrally with the drive shaft 107. During the rotation, the hinge mechanism 110 enables the swash plate 109 to move between a maximum inclination position and a minimum inclination position while sliding on the drive shaft 107. As shown in the enlarged view of FIG. 11(*b*), a slight clearance is provided between the wall of the guide bore 111*a* and the associated sperical portion 112*a* in the hinge mechanism 110. The clearance permits smooth movement of the swash plate 109.

A pressurizing passage 113 connects the discharge chamber 104 with the crank chamber 102, while a conduit 114 connects the crank chamber 103 with the suction chamber 103. A displacement control valve 115 is arranged in the pressurizing passage 113. The control valve 115 adjusts the opening amount of the pressurizing passage 113 to alter the amount of refrigerant gas sent from the discharge chamber 104 to the crank chamber 102. This, in turn, adjusts the pressure in the crank chamber 102 in correspondence with the amount of refrigerant gas released through the conduit 114. The difference between the pressures acting on each side of the pistons 106, that is, the difference between the pressure in the crank chamber 102 and the pressure in the cylinder bores 101, is thus changed. As a result, the swash plate 109 is moved between the maximum inclination position and the minimum inclination position. This alters the stroke of each piston 106 and varies the displacement.

A projection 109*a* projects from the inner rear surface of the swash plate 109. A shutter 121 is arranged to abut against the projection 109*a* by way of a thrust bearing 122. As the swash plate 109 slides toward the minimum inclination position, the projection 109*a* and the thrust bearing 122 push the shutter 121. When the swash plate 109 is arranged at the minimum inclination position, a shutting surface 123, which is defined on the shutter 121, abuts against a positioning surface 124, which is defined on the corresponding inner wall of the housing 105. This disconnects the suction chamber 103 from a suction passage 125, which is connected to an external refrigerant circuit. In other words, when the shutter 121 disconnects the suction chamber 103 from the suction passage 125, the abutment between the shutting surface 123 and the positioning surface 124 restricts further sliding of the swash plate 109. In this state, the swash plate 109 is located at the minimum inclination position.

When the shutter 121 blocks the flow of refrigerant gas, the circulation of refrigerant gas through the external refrigerant circuit is impeded. This is advantageous in that the operation of the compressor, or rotation of the drive shaft 107, is continued even when cooling is not required. This structure eliminates the need for a costly and heavy clutch, which would be arranged between the drive shaft 107 and a vehicle engine 126. Consequently, the elimination of the clutch prevents shocks that would be produced when actuating or de-actuating the clutch.

A first spring 116, which is a coil spring, is located between the rotor 108 and the swash plate 109 on the drive shaft 107 to urge the swash plate 109 toward the minimum inclination position. Therefore, if operation of the compressor is stopped when the engine 126 is stopped and the pressure in the compressor thus becomes uniform, the first spring 116 sustains the swash plate 109 at the minimum inclination position. As a result, when the compressor commences operation, the displacement is minimum. In such a state, the torque load required for operating the compressor is minimum. Thus, the shock produced when starting operation is effectively suppressed.

A top dead center (TDC) portion 109*b*, which arranges each piston 106 at its top dead center position, and a bottom dead center (BDC) portion 109*c*, which arranges each piston 106 at its bottom dead center position, are defined on the swash plate 109. The piston 106 illustrated in FIG. 10 is arranged at the top dead center position by the TDC portion 109*b*. The BDC position 109*c* is shown on the opposite side of the drive shaft 107 in the drawing.

Two planes 117, 118 are defined on the central front of the swash plate 109, which is the surface facing the first spring 116. The first plane 117 extends from the TDC portion 109*b* toward the center of the swash plate 109. The second plane 118 extends from the BDC portion 109*c* toward the center of the swash plate 109. The first and second planes 117, 118 are inclined so that they become closer to the rotor 108 at positions closer to the intersection between the two planes 117, 118, or the ridge line K11.

The first spring 116 abuts against the swash plate 109 along the ridge line K11 between the planes 117, 118 when the swash plate 109 is located at the minimum inclination position. In this state, the swash plate 109 abuts against the thrust bearing 122. A line T is defined between the swash plate 109 and the thrust bearing 122. The swash plate 109 pivots about line T when inclining toward the minimum inclination position. The line T is included in a hypothetical plane H (FIG. 12), which extends parallel to the axis L of the drive shaft 107. As shown in FIGS. 11(*a*), 11(*b*), and 12, when the swash plate 109 is located at the minimum inclination position, the ridge line K11 is located at a position closer to the TDC portion 109*b* than the line T. More specifically, the ridge line K11 is located at a position closer to the TDC portion-109*b* than the hypothetical plane H.

Accordingly, when the swash plate 109 is located at the minimum inclination position, the first spring 116 presses the TDC portion 109*b* of the swash plate 109 and produces an inclining moment M11 that acts about the line T in a direction increasing the inclination of the swash plate 109. The clearance between the wall of the guide bore 111*a* and the associated spherical portion 112*a* in the hinge mechanism 110 permits a slight inclination of the swash plate 109 when located at the minimum inclination position.

Consequentially, when the operation of the compressor is stopped, each spherical portion 112*a* is pressed against the swash plate side of the wall of the associated guide bore 111*a* (toward the right as viewed in the drawing). Therefore, the minimum inclination position of the swash plate 109 is so determined when the compressor is not operating.

However, during operation of the compressor, when each piston 106 approaches its top dead center position, a compression reaction is produced. The compression reaction acts on the swash plate 109 and forms an inclining moment M12 that acts about the line T in a direction decreasing the inclination of the swash plate 109. The inclining moment M12 is greater than the inclining moment M11, which is produced by the first spring 116. Accordingly, when the compressor is operated, each spherical portion 112*a* is pressed against the rotor side of the wall of the associated guide bore 111*a*. Thus, the direction each spherical portion 112*a* is pressed toward when the compressor is in operation is opposite the direction of that when the compressor is not in operation. Hence, the minimum inclination position of the swash plate 109 is so determined when the compressor is operating.

In other words, in the prior art compressor, the minimum inclination position of the swash plate 109 differs when the compressor is operating from when the compressor stops operation. The angle of the swash plate 109 at the minimum inclination position is determined during assembly of the compressor. However, when the compressor commences operation, the minimum inclination position of the swash plate 109 is displaced from the determined angle. This displacement must be taken into consideration when installing the swash plate 109. As a result, burdensome installation steps must be taken.

SUMMARY OF THE INVENTION

Accordingly, it is an objective of the present invention to provide a variable displacement compressor that maintains its cam plate at the same inclination angle when located at the minimum inclination position regardless of whether the compressor is operating or not.

To achieve the above objectives, the present invention provides a variable displacement type compressor. The compressor includes a housing having a cylinder bore therein, a piston located in the cylinder bore, a drive shaft rotatably supported by the housing, a rotary support mounted on the drive shaft, and a cam plate connected to the piston. The cam plate is supported tiltably on the drive shaft and is slidable in axial directions of the drive shaft. The cam plate inclines between a maximum inclination position and a minimum inclination position when the displacement of the compressor is changed. A hinge mechanism is located between the rotary support and the cam plate. The hinge mechanism includes a first hinge part fixed to the cam plate and a second hinge part connected to the rotary support such that the first and second hinge parts engage with one another to form the hinge mechanism. A predetermined clearance exists between the first hinge part and the second hinge part, which permits a slight degree of slack in the movement of the cam plate in its inclining direction. The slack is taken up such that the hinge mechanism positively defines the angle of inclination of the swash plate when the cam plate is in its minimum inclination position while the compressor is running due to a first moment applied to the cam plate by a compression reaction force of the piston. The cam plate rotates integrally with the drive shaft, the rotary support, and the hinge mechanism. An urging means is located between the rotary support and the cam plate for urging the cam plate toward the minimum inclination angle position. An applying means applies a second moment to the swash plate in the same direction as the first moment when the compressor is not operating.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a clutchless-type variable displacement compressor according to the present invention will now be described with reference to the drawings.

Figure 1:
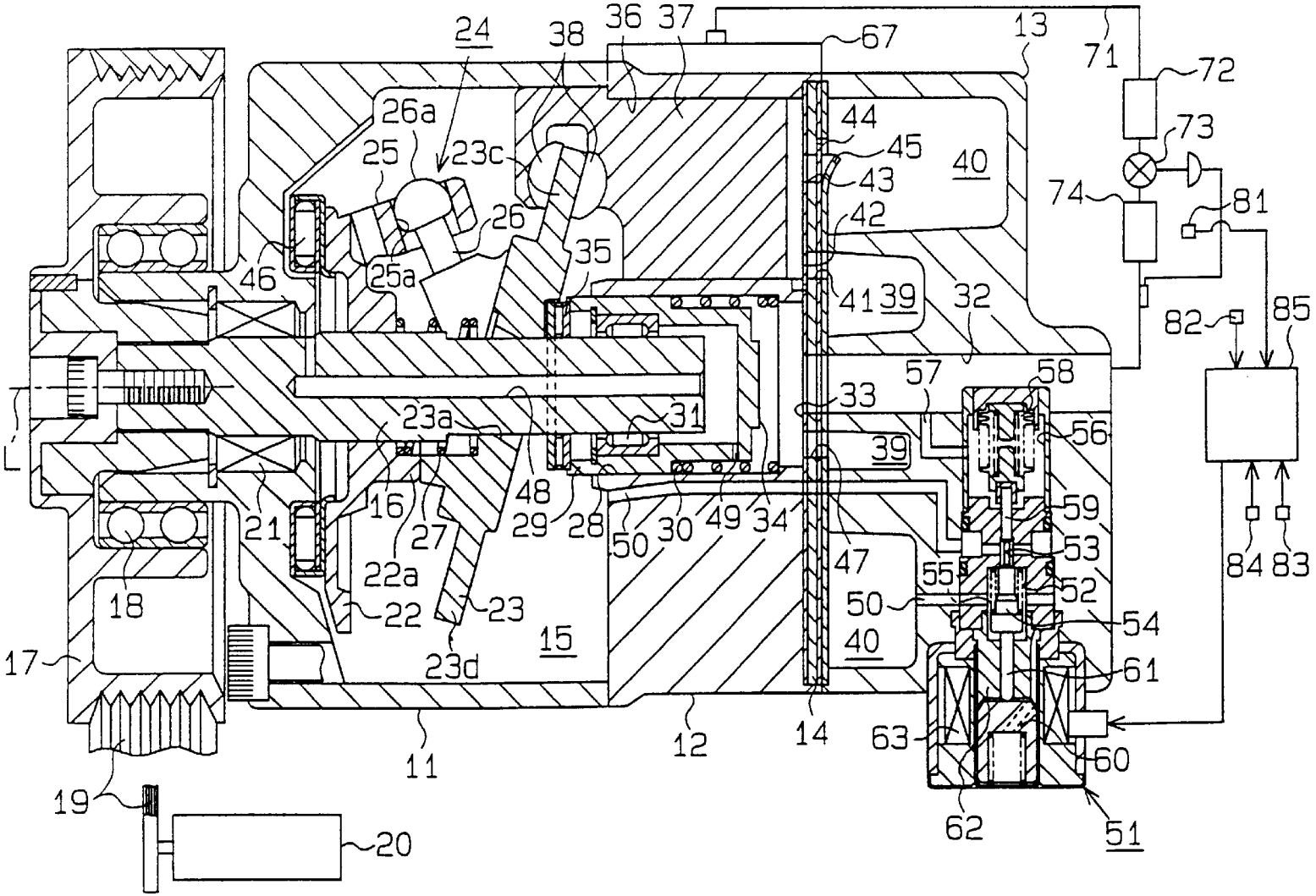
FIG. 1 is a cross-sectional view showing a first embodiment of a clutchless-type variable displacement compressor according to the present invention.
Figure 2:
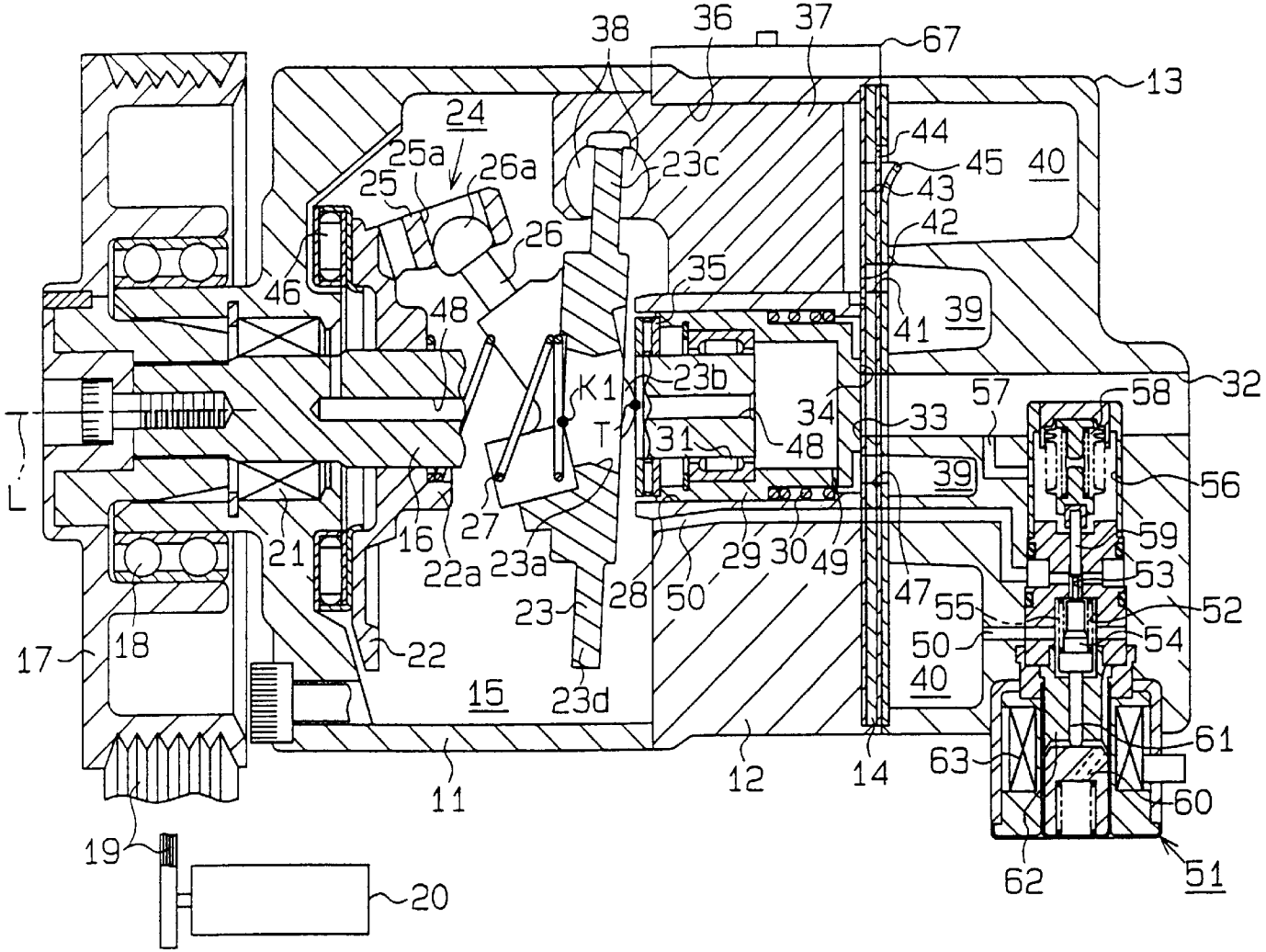
FIG. 2 is a cross-sectional view showing the compressor of FIG. 1 in a minimum displacement state.

As shown in FIGS. 1 and 2,. the compressor has a front housing 11 that is fixed to the front end of a cylinder block 12. A rear housing 13 is fixed to the rear end of the cylinder block 12 with a valve plate 14 arranged in between. The front housing 11, the cylinder block 12, and the rear housing 13 constitute a compressor housing. A crank chamber 15 is defined in the front housing 11 in front of the cylinder block 12. A drive shaft 16 is rotatably supported to extend through the crank chamber 15. A pulley 17 is rotatably supported by means of an angular bearing 18 at the front wall of the front housing 11. The pulley 17 is coupled to the end of the drive shaft 16 projecting from the front housing 11. A belt 19 connects the pulley 17 directly with a vehicle engine 20, which serves as an external drive source. Thus, the compressor and the engine 20 are directly connected to each other without employing a clutch mechanism such as an electromagnetic clutch.

A lip seal 21 seals the space between the front portion of the drive shaft 16 and the front housing 11. A rotary support, or rotor 22, is secured to the drive shaft 16 in the crank chamber 15. A swash plate 23, which serves as a cam plate, is accommodated in the crank chamber 15. The drive shaft 16 is inserted through a central bore 23*a* defined at the center of the swash plate 23. The swash plate 23 is supported by the drive shaft 16 in a manner enabling the swash plate 23 to slide along the axis L of the drive shaft 16 while inclining with respect to the drive shaft 16. A top dead center (TDC) portion 23*c*, which arranges each piston 37 at its top dead center position, and a bottom dead center (BDC) portion 23*d*, which arranges each piston 37 at its bottom dead center position, are defined on the swash plate 23. The piston 37 illustrated in FIG. 1 is arranged at the top dead center position by the TDC portion 23*c*. The BDC position 23*d* is shown on the opposite side of the drive shaft 16 in the drawing.

The piston 37 shown in FIGS. 1 and 2 is located at the top dead center position. If the drive shaft 16 is rotated by 180° from the state shown in the drawings, the BDC portion 23*d* moves the piston 37 to its bottom dead center position.

A hinge mechanism 24 is provided between the rotor 22 and the swash plate 23. The hinge mechanism 24 includes support arms 25, which extend from the rear surface of the rotor 22, and associated guide pins 26, which project from the swash plate 23. Each guide pin 26 has a spherical portion 26*a*, which is slidably fitted into a guide bore 25*a* extending through the associated support arm 25. The swash plate 23 rotates integrally with the drive shaft 16 by means of the rotor 22 and the hinge mechanism 24. The swash plate 23 is supported on the drive shaft 16 so that the engagement between the guide bores 25*a* and the associated spherical portions 26*a* enables the swash plate 16 to incline while sliding along the drive shaft 16.

A first spring 27, which is a coil spring, is arranged on the drive shaft 16 between the rotor 22 and the swash plate 23. The first spring 26 abuts against the central front portion of the swash plate 23 and urges the swash plate 23 toward the cylinder block 23 along the axis L of the drive shaft 16.

A shutter bore 28 extends through the center of the cylinder block 12 coaxially with the drive shaft 16. A cup-shaped shutter 29 is slidably accommodated in the shutter bore 28. A second spring 30 is arranged in the shutter bore 28 to urge the shutter 29 toward the swash plate 23.

The rear end of the drive shaft 16 is inserted into the shutter 29. A radial bearing 31 is arranged between the rear portion of the drive shaft 16 and the inner wall of the shutter 29. The radial bearing 31 and the shutter 29 are supported so that they slide together axially along the drive shaft 16.

A suction passage 32 extends through the rear housing 13 and the center of the valve plate 14. The suction passage 32 is connected with the shutter bore 28. A positioning surface 33 is defined around the suction passage 32 on the front surface of the valve plate 14. A shutting surface 34 is defined on the end face of the shutter 29. The movement of the shutter 29 contacts and separates the shutting surface 34 and the positioning surface 33. Contact between the shutting surface 34 and the positioning surface 33 seals the space in between and disconnects the suction passage 32 from the shutter bore 28.

An annular thrust bearing 35 is slidably arranged on the drive shaft 16 and located between the opened end of the shutter 29 and a pair of protrusions 23*b* protruding from the rear central surface of the swash plate 23. The force of the second spring 30 keeps the thrust bearing 35 held between the protrusions 23*b* of the swash plate 23 and the shutter 29.

The inclination of the swash plate 23 with respect to a plane perpendicular to the axis L of the drive shaft 16 decreases as the swash plate 23 slides along the drive shaft 16 toward the cylinder block 12. As the inclination of the swash plate 23 decreases, the swash plate 23 pushes the shutter 29 with the protrusions 23*b* and the thrust bearing 35 toward the positioning surface 33 against the force of the second spring 30. When the shutting surface 34 of the shutter 29 abuts against the positioning surface 33, further inclination of the swash plate 23 is-restricted. In this state, the inclination of the swash plate 23 is minimum and slightly greater than zero degrees. FIG. 2 shows the swash plate 23 located at the minimum inclination position. With the shutter 29 abutted against the valve plate 14, the minimum inclination position of the swash plate 23 is determined by the shutter 29, the valve plate 14, and the thrust bearing 35.

The inclination of the swash plate 23 with respect to a direction perpendicular to the axis L of the drive shaft 16 increases as the swash plate 23 slides along the drive shaft 16 toward the rotor 22. As the inclination of the swash plate 23 increases, the force of the second spring 30 moves the shutting surface 34 away from the positioning surface 33. A stopper 22*a* projects from the rear surface of the rotor 22. The abutment of the swash plate 23 against the stopper 22*a* restricts further sliding of the swash plate 23. In this state, the inclination of the swash plate 23 is maximum. FIG. 1 shows the swash plate 23 located at the maximum inclination position.

Cylinder bores 36 (only one shown in the drawings) extend through the cylinder block 12. Each cylinder bore 36 retains a single-headed piston 37. Each piston 37 is coupled to the peripheral portion of the swash plate 23 by shoes 38. The rotation of the swash plate 23 is converted to linear reciprocation of the pistons 37.

A suction chamber 39 and a discharge chamber 40 are defined in the rear housing 13. For each cylinder bore 36, the valve plate 41 has a suction port 41, a suction flap 42 for closing the suction port 41, a discharge port 43, and a discharge flap 44 for closing the discharge port 43. Refrigerant gas in the suction chamber 39 is drawn into each cylinder bore 36 through the suction port 41 as the associated piston 37 moves away from the valve plate 14 toward its bottom dead center position. The refrigerant gas drawn into the cylinder bore 36 is compressed and then sent to the discharge chamber 40 through the discharge port 43 as the piston 37 moves back to the valve plate 14 toward its top dead center position. The angle of the discharge flaps 44 when opened is restricted by a retainer 45 fixed to the valve plate 14.

A thrust bearing 46 is arranged between the rotor 22 and the front housing 11. The thrust bearing 46 receives the compression reaction that is produced during compression of the refrigerant gas and that is transmitted to the rotor 22 by way of the pistons 37 and the swash plate 23.

The auction chamber 39 is connected to the shutter bore 28 through an opening 47. When the shutting surface 34 of the shutter 29 abuts against the positioning surface 33, the opening 47 is disconnected from the auction passage 32.

A conduit 48 extends through the drive shaft 16. A pressure releasing aperture 49 extends through the wall of the shutter 29. The crank chamber 15 and the shutter bore 28 are connected to each other by the conduit 48 and the aperture 49.

A pressurizing passage 50 connects the discharge chamber 40 to the crank chamber 15. A displacement control valve 51 is arranged in the pressurizing passage 50. The control valve 51 includes a valve chamber 52, a port 53, a valve body 54, and a spring 55. The valve chamber 52 constitutes part of the pressurizing passage 50. The port 53 is connected with the valve chamber 52. The valve body 54 is accommodated in the vale chamber 52 and moved to and away from the port 53. The spring 55 is arranged in the valve chamber 52 to urge the valve body 54 away from the port 53.

A pressure chamber 56 is defined adjacent to the valve chamber 52. The pressure chamber 56 is connected to the suction passage 32 by a pressure passage 57. A bellows 58 is accommodated in the pressure chamber 56 and operably connected to the valve body 54 by way of a rod 59.

A movable steel core 60 is arranged in the control valve 51 so that the bellows 58 is located at the opposite side of the valve body 54 from the core 60. A fixed steel core 62 is faced toward the moveable core 60. A solenoid 63 is arranged about the movable and fixed cores 60, 62. When a predetermined amount of electric current flows through the solenoid 63, a magnetic field corresponding to the current value is generated between the cores 60, 62. The magnetic field produces an attractive force between the cores 60, 62. The attractive force is transmitted to the valve body 54 by way of a rod 61 against the force of the spring 55 in a direction that results in a decrease in the opened area of the port 53.

Refrigerant gas is drawn into the suction chamber 39 through the suction passage 32 and discharged from the discharge chamber 40 though a discharge flange 67. The suction passage 32 and the discharge flange 67 are connected to an external refrigerant circuit 71. The refrigerant circuit 71 includes a condenser 72, an expansion valve 73, and an evaporator 74. An evaporator temperature sensor 81, a passenger compartment temperature sensor 82, an air-conditioner switch 83, and a temperature setting device 84 for setting the desired temperature in the passenger compartment are connected to a controller 95.

When the air-conditioner switch 83 is turned on, the solenoid 63 is excited when the temperature detected by the temperature sensor 82 becomes greater than the temperature set by the temperature setting device 84. Exciting the solenoid 63 with the predetermined amount of current generates an attractive force between the cores 60, 62 in accordance with the current value.

The bellows 58 is deformed in accordance with changes in the pressure of the refrigerant gas drawn into the pressure chamber 56 from the suction passage 32 through the pressure passage 57. This pressure is also referred to as the suction pressure. When the solenoid 63 is excited, the bellows 58 becomes sensitive to the suction pressure. Deformation of the bellows corresponding to the suction pressure is transmitted to the valve body 54 by way of the rod 59. The opening amount of the control valve 51 is determined in accordance with the exciting and de-exciting of the solenoid 63 and the balance between the forces of the bellows 58 and the spring 55.

The load applied to the compressor for cooling becomes great when there is a large difference between the temperature in the passenger compartment, which is detected by the passenger compartment temperature sensor 82, and the desired temperature in the passenger compartment, which is set by the temperature setting device. In such cases, the controller 85 controls the value of the current flowing through the solenoid 63 to alter the pressure of the refrigerant gas drawn into the compressor, or the suction pressure, in accordance with the temperature difference. The controller 85 increases the current value as the temperature difference becomes greater. Accordingly, the attractive force acting between the fixed core 62 and the movable core 60 becomes stronger. This increases the force acting on the valve body 54 in a direction that closes or restricts the port 53. Thus, the valve body 54 becomes sensitive to lower suction pressures and opens or closes the port 53 at lower suction pressures. Accordingly, a lower suction pressure is required to open the control valve 51 when the value of the current flowing through the solenoid 63 is increased.

A decrease in the size of the opening of the port 53 decreases the amount of refrigerant gas that flows into the crank chamber 15 from the discharge chamber 40 by way of the pressurizing passage 50. The refrigerant gas in the crank chamber 15 is sent to the suction chamber 39 by way of the conduit 48 and the aperture 49. This decreases the pressure in the crank chamber 15. When the cooling load applied to the compressor is great, the pressure (suction pressure) in the cylinder bores 36 is high. Thus, the difference between the pressure in the crank chamber 15 and the pressure in the cylinder bores 36 becomes small. As a result, the swash plate 23 is moved toward the maximum inclination position.

When the port 53 is closed, the high pressure refrigerant gas in the discharge chamber 40 is not sent to the crank chamber 15. Thus, the pressure in the crank chamber 15 becomes about the same as the pressure in the suction chamber 39 and moves the swash plate 23 toward the maximum inclination position.

If the cooling load applied to the compressor is small, the difference between the passenger compartment temperature and the set desired temperature becomes small. The controller 85 decreases the value of the current flowing through the solenoid 63. Accordingly, the attractive force acting between the fixed core 62 and the movable core 60 becomes weak. This decreases the force acting on the valve body 54 in the closing direction. Thus, the valve body 54 opens or closes the port 53 at higher suction pressures. Accordingly, a higher suction pressure will op en the control valve 51 when the value of the current flowing through the solenoid 63 is decreased.

An increase in the opening size of the port 53 increases the amount of refrigerant gas that flows into the crank chamber 15. This increases the pressure in the crank chamber 15. When the cooling load applied to the compressor is small, the suction pressure in the cylinder bores 36 is low. Thus, the difference between the pressure in the crank chamber 15 and the pressure in the cylinder bores 36 becomes large. As a result, the swash plate 23 is moved toward the minimum inclination position.

As the cooling load applied to the compressor becomes null, the temperature of the evaporator 74 approaches a temperature at which frost forms. The controller 85 de-excites the solenoid 63 when the temperature detected by the evaporator temperature sensor 81 becomes lower than the temperature at which frost starts to form. The controller 85 also de-excites the solenoid 63 when the air-conditioner switch 83 is turned off.

De-exciting the solenoid 63 maximizes the opening of the port 53 under the force of the spring 55. Thus, a large amount of the high pressure refrigerant gas in the discharge chamber 54 is sent to the crank chamber 15 through the pressurizing passage SO This increases the pressure in the crank chamber 15 and moves the swash plate 23 toward the minimum inclination position.

The operation of the control valve 51 is altered in accordance with the value of the current flowing through the solenoid 63. If the current value increases, the control valve 51 is opened and closed at lower suction pressures. If the current value decreases, the control valve 51 is opened and closed at higher suction pressures. The compressor alters the inclination of the swash plate 23 and varies its displacement to maintain the set suction pressure. In other words, the control valve 51 functions to alter the set suction pressure in correspondence with changes in the current value and functions to operate the compressor in a minimum displacement state regardless of the suction pressure. Thus, the employment of the control valve 51 varies the refrigerating capability of the refrigerant circuit.

When the swash plate 23 is located at the minimum inclination position, the shutting surface 34 of the shutter 29 abuts against the positioning surface 33. This disconnects the suction passage 32 from the suction chamber 39. In this state, the flow of refrigerant gas from the external refrigerant circuit 71 into the suction chamber 39 is impeded. Since the inclination of the swash plate 23 is slightly greater than zero degrees at the minimum inclination position, the discharge of refrigerant gas from the cylinder bores 36 into the discharge chamber 39 is continued. The difference between the pressure in the crank chamber 15 and the pressure in the discharge chamber 40 causes the refrigerant gas discharged into the discharge chamber 40 from the cylinder bores 36 to circulate through the pressurizing passage 48, the crank chamber 15, the conduit 48, the aperture 49, the shutter bore 28, the suction chamber 39, the cylinder bores 36, and the discharge chamber 40. Moving parts are lubricated during the circulation of the refrigerant gas by the lubricating oil suspended in the gas.

When the air-conditioner switch 83 is turned on with the swash plate 23 located at the minimum inclination position, an increase in the temperature of the passenger compartment increases the cooling load applied to the compressor. If the temperature detected by the temperature sensor 82 exceeds the temperature set by the temperature setting device 84, the controller 85 excites the solenoid 63 and closes the pressurizing passage 50. Accordingly, the pressure in the crank chamber 15 is released through the conduit 48 and the aperture 49. This decreases the pressure in the crank chamber 15 and causes the second spring 30 to be extended from the compressed state shown in FIG. 2. As a result, the shutter 29 is moved and the shutting surface 33 is separated from the positioning surface 33. This permits the refrigerant gas in the suction passage 32 to enter the suction chamber 39.

When the engine 20 stops running, the compressor stops operation. In other words, the rotation of the swash plate 23 is stopped and the flow of current through the solenoid 63 of the control valve 51 is stopped. This de-excites the solenoid 63, opens the pressurizing passage 50, and moves the swash plate 23 to the minimum inclination position. If the compressor remains stopped, the pressure in the compressor becomes uniform. However, the swash plate 23 is sustained at the minimum inclination position by the force of the first spring 27. Accordingly, when the compressor commences operation during starting of the engine 20, the swash plate 23 starts rotating at the minimum inclination position. At this position, the load torque is minimal. Thus, there is substantially no shock when the compressor commences operation.

Figures 3A, 3B, 3C:
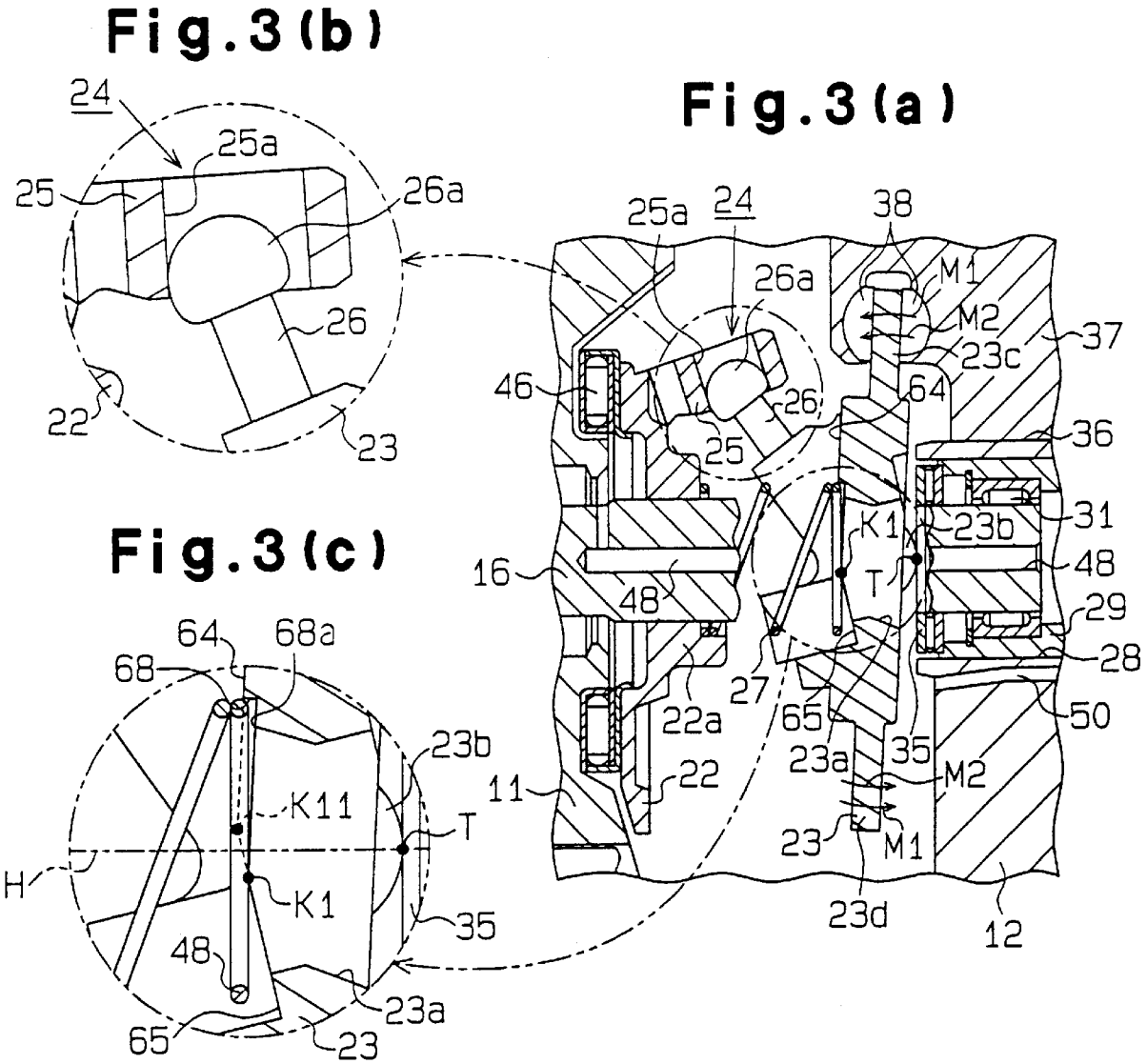
FIGS. 3(*a*), 3(*b*), and 3(*c*) are partial cross-sectional views showing the compressor of FIG. 1.

As shown in FIG. 3(*b*), in the hinge mechanism 24*a*, a slight clearance is provided between each guide bore 25*a* and the associated spherical portions 26*a*. When the swash plate 23 is located at the minimum inclination position, the clearance permits the swash plate 23 to pivot slightly about line T, which extends along the swash plate 23 where the thrust bearing 35 abuts against the protrusions 23*b*. This slightly inclines the swash plate 23.

During operation of the compressor, the pistons 37 located near the top dead center produce a compression reaction that acts on the swash plate 23. The compression reaction causes an inclining moment M1 that acts about the line T in a direction that decreases the inclination of the swash plate 23. Accordingly, the inclination of the swash plate 23 at the minimum inclination position is determined when the spherical portions 26*a* of the hinge mechanism 24 are pressed against the rotor side of the wall of the associated guide bore 25*a*.

The location of contact between the first spring 27 and the swash plate 23 is set so that the inclination of the swash plate 23 when at the minimum inclination position remains the same regardless of whether the compressor is in operation or not.

As shown in FIGS. 3(*a*), 3(*b*), 3(*c*) and 4, the central front surface of the swash plate 23, which faces the first spring 27, has two planes 64, 65. The first plane 64 extends toward the center of the swash plate 23 from the TDC portion 23*c*. The second plane 65 extends toward the center of the swash plate 23 from the BDC portion 23*d*. The first and second planes 64, 65 are inclined such that they are closer to the rotor 22 at the center of the swash plate 23. A ridge line K11 is defined at the intersection between the first and second planes 64, 65.

The swash plate 23 of FIG. 1 differs from the prior art swash plate 109 in that a semi-cylindrical spring seat 68 (see FIG. 3(*c*)), which receives the first spring 27, is defined in the first plane 64 about the central bore 23*a*. The spring seat 68 has a seat surface 68*a*. The ends of the spring seat 68 meet with the second plane 65. The seat surface 68*a* extends deeper into the swash plate 23 than the first plane 64. A ridge line K12 defined at the intersection between the seat surface 68*a* and the second plane 65 extends closer to the BDC portion 23*d* than a hypothetical plane H, which includes line T as a component and which is parallel to the drive shaft 16. The first spring 27 abuts against the swash plate 23 at the ridge line K12 when the swash plate 23 is moved to the minimum inclination position.

Accordingly, when the swash plate 23 is located at the minimum inclination position, the first spring 27 presses the BDC portion side of the swash plate 23 in a direction that decreases the inclination of the swash plate 23. This produces an inclining moment M2 that is oriented in the same direction as inclining moment M1. Consequently, the angle of the swash plate 23 arranged at the minimum inclination position is determined in the same manner as when the compressor is in operation. That is, the inclination of the swash plate 23 is always determined by the abutment of each spherical portion 26*a* in the hinge mechanism 24 against the rotor side of the wall of the associated guide bore 25*a*.

In the preferred embodiment, the inclination of the swash plate 23 is the same regardless of whether the compressor is operating or not. Accordingly, the setting of the minimum inclination during installation of the swash plate 23 is facilitated. This simplifies the assembly of the compressor. As a result, costs are reduced and the compressors have more precise displacements.

The position at which the first spring 27 abuts against the swash plate 23 maintains the swash plate 23 at the same angle when located at the minimum inclination position regardless of whether the compressor is operating or not. In the preferred embodiment, the spring seat 68 is provided on the prior art swash plate 109. Thus, the swash plate 23 may be manufactured by merely adding the step of machining the spring seat 68. This contributes to further reductions in manufacturing costs. Furthermore, the machining of the swash plate 23 to form the spring seat 68 reduces the weight of the swash plate 23. This contributes to a lighter compressor.

The shutter 29 stops the flow of refrigerant gas from the external refrigerant circuit 71 and impedes the circulation of the refrigerant gas in the external refrigerant circuit 71. This enables the compressor to be operated even when cooling is not required. There are no clutch mechanisms, such as costly, heavy electromagnetic clutches, arranged between the drive shaft 16 and the engine 20. Thus, shocks that are produced when actuating or de-actuating the electromagnetic clutch, which are uncomfortable to the driver, are not produced.

The shutter 29 impedes the circulation of refrigerant gas through the external refrigerant circuit 71 when the swash plate 23 is located at the minimum inclination position. In this state, the displacement of the compressor is minimal and the compressor may be driven by a small torque. Thus, power loss is decreased during the impeding of the refrigerant gas circulation.

In a clutchless-type compressor, during minimum displacement operation, it is important that the internal circulation of the refrigerant gas be optimized (to cause internal circulation of as much lubricating oil as possible) while also reducing power loss. Thus, the setting of the minimum inclination of the swash plate 23 is important. Accordingly, the structure of the preferred embodiment determines the angle of the swash plate 23 when located at the minimum inclination position and is thus advantageous.

Figures 5A, 5B, 5C:
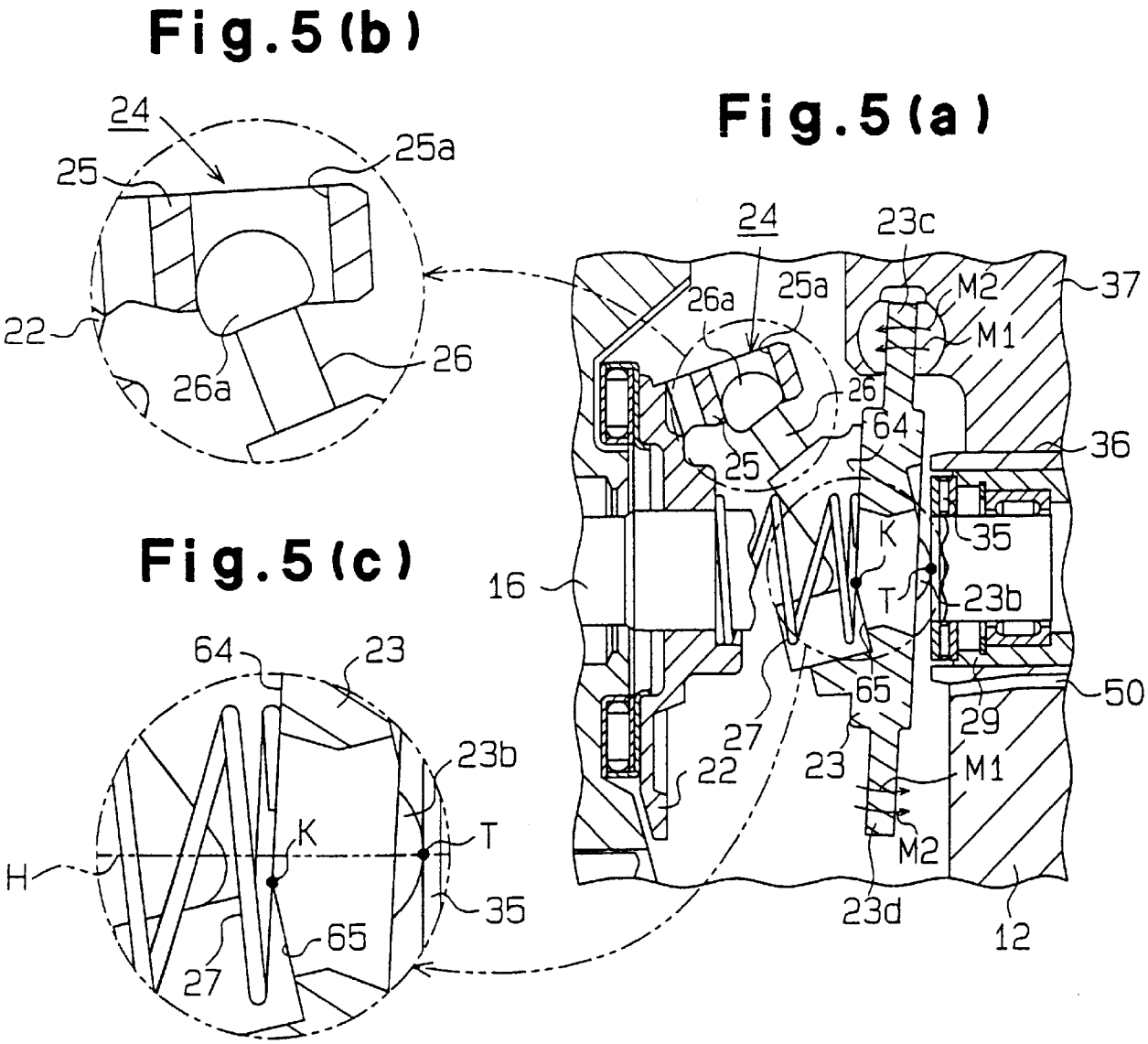
FIGS. 5(*a*), 5(*b*), and 5(*c*) are partial cross-sectional views showing another embodiment of a compressor according to the present invention.
Figure 6:
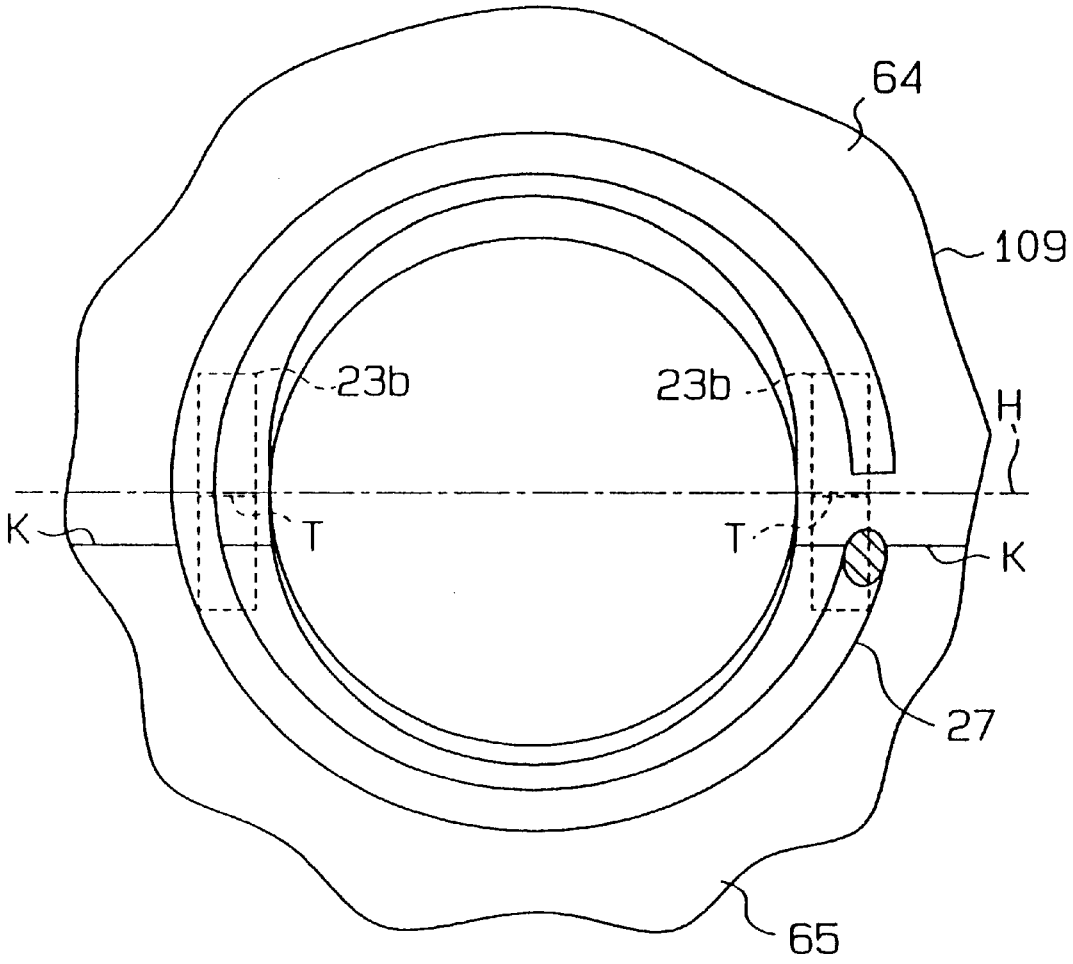
FIG. 6 is an enlarged partial view showing the vicinity of the central bore in the swash plate of the compressor of FIG. 5(*a*)

Another embodiment according to the present invention will now be described with reference to the drawings. Parts differing from the first embodiment will be described with reference to FIGS. 5(*a*), 5(*b*), 5(*c*), and 6. In this embodiment, the spring seat 68 is eliminated from the swash plate 23. The first and second planes 64, 65 are defined so that the ridge line K of the planes 64, 65 is located closer to the BDC portion 23*c* than the hypothetical plane H. Accordingly, when the swash plate 23 is located at the minimum inclination position, the first spring 27 presses the BDC portion 23*c* of the swash plate 23 and causes an inclining moment M2 to act in a direction that decreases the inclination of the swash plate 23, that is, the same direction as inclining moment M1 produced by compressor reaction. As a result, the angle of the swash plate 23 at the minimum inclination position is determined with each spherical portion 26*a* in the hinge mechanism 24 abutted against the rotor side of the wall of the associated guide bore 25*a* regardless of whether the compressor is in operation or not. Thus, the angle of the swash plate 23 when located at the minimum inclination position is the same whether the compressor is in operation or not.

In the above embodiments, the inclination of the swash plate 23 is altered by controlling the pressure in the crank chamber 15. The pressure is controlled by adjusting the amount of refrigerant gas drawn into the crank chamber 15 from the discharge chamber 40. This structure may be modified to a structure that constantly communicates the crank chamber 15 with the discharge chamber 40. In this case, the displacement control valve may be arranged along the bleeding passage (47, 48, or 49) to adjust the amount of refrigerant gas released from the crank chamber 15 into the suction chamber 39 and adjust the pressure in the crank chamber 15. Furthermore, the present invention may also be embodied in a variable displacement compressor that employs clutches.

A further embodiment according to the present invention will now be described with reference to FIGS. 7 to 9.

Like the above embodiments, in this embodiment, when the swash plate 23 is located at the minimum inclination position, the ridge line K between the first and second planes 64, 65 is located closer to the BDC portion 23*d* than the line T, or the hypothetical plane H extending parallel to the drive shaft 16 and including the line T. The swash plate 23 comes into contact with the thrust bearing 35 and pivots about line T when arranged at the minimum inclination position. The first spring 27 has a final turn 27*a* that abuts against the swash plate. 23 at the ridge line K when the swash plate 23 is located at the minimum inclination position. Accordingly, when the swash plate 23 is located at the minimum inclination position, the first spring 27 presses the BDC portion 23*c* of the swash plate 23 and produces an inclining moment M1 acting in a direction that decreases the inclination of the swash plate 23, that is, the same direction as inclining moment M2. As a result, the inclination of the swash plate 23 at the minimum inclination position is determined with each spherical portion 26*a* in the hinge mechanism 24 abut against the rotor side of the wall of the associated guide bore 25*a* regardless of whether the compressor is in operation or not.

The final turn 27*a* of the first spring 27 includes a spring end 27*b* and a free portion 27*c*. The free portion 27*c* extends between the contact point with the ridge line K and the spring end 27*b*. Like in the prior art compressors, if the first spring is loosely fitted and rotates about the drive shaft, the free portion 27*c* may extend over a wide range over the TDC portion 23*c* and away from the ridge line K depending on the relative position between the ridge line K and the spring end 27*b*. This results in the first spring 27 pressing the TDC portion side of the swash plate 23. In this case, in addition to the inclining moment M1, a further moment M3 oriented toward the direction increasing the inclination, acts on the swash plate 23. The inclining moment M3 lifts each spherical portions 26*a* in the hinge mechanism 24 away from the wall of the associated guide bore 25*a*. This causes the inclination of the swash plate 23 to differ slightly when the compressor is in operation and when not in operation.

In FIGS. 9(*a*) and 9(*d*), the first spring 27 is shown with its final turn 27*a* abut against the ridge line K at the vicinity of the spring end 27*b*. The length between the contact point and the spring end 27*b*, or the free portion 27*c*, is thus short. Since the free end 27*c* extending toward the swash plate 23 from the ridge line K is short, the problems of the prior art do not occur.

If the first spring 27 is rotated relative to the drive shaft 16 so that the position of the spring end 27*b* with respect to the ridge line K is shifted from the positions shown in FIG. 9(*a*) and 9(*b*) to the position shown in FIG. 9(*c*), the free portion 27*c* gradually becomes longer. However, at these positions, the free portion 27*c* extends over the BDC portion side of the ridge line K no matter how long the free portion 27*c* becomes. Accordingly, the inclining moment M3 that acts on the swash plate 23 is not produced.

If the first spring 27 is further rotated so that the position of the spring end 27*b* with respect to the ridge line K is shifted from the positions shown in FIGS. 9(*d*) and 9(*e*) to the position shown in FIG. 9(*f*), the spring end 27*b* enters the TDC portion side of the ridge line K. In addition, the free portion 27*c*, which extends over the TDC portion side gradually becomes longer as the first spring 27 is rotated. The free portion 27*c* presses the TDC portion side of the swash plate 23, especially when the first spring 27 is arranged at the positions shown in FIGS. 9(*e*) and 9(*f*). This produces the inclining moment M3 that acts on the swash plate 23 countering the inclining moment M3.

Accordingly, at least one of the following two conditions must be satisfied to avoid inclining moment M3 from acting on the swash plate 23 when the swash plate 23 is located at the minimum inclination position.

(1) The spring end 27*b* is not located at the TDC portion side of the ridge line K (more specifically, the TDC portion side of the hypothetical plane H parallel to the axis L and including the ridge line K) but is located at the BDC portion side.

(2) In the final turn 27*a*, the free end 27*c*, which is defined between the point of contact with the ridge line K and the spring end 27*b* is not long.

Figure 8:
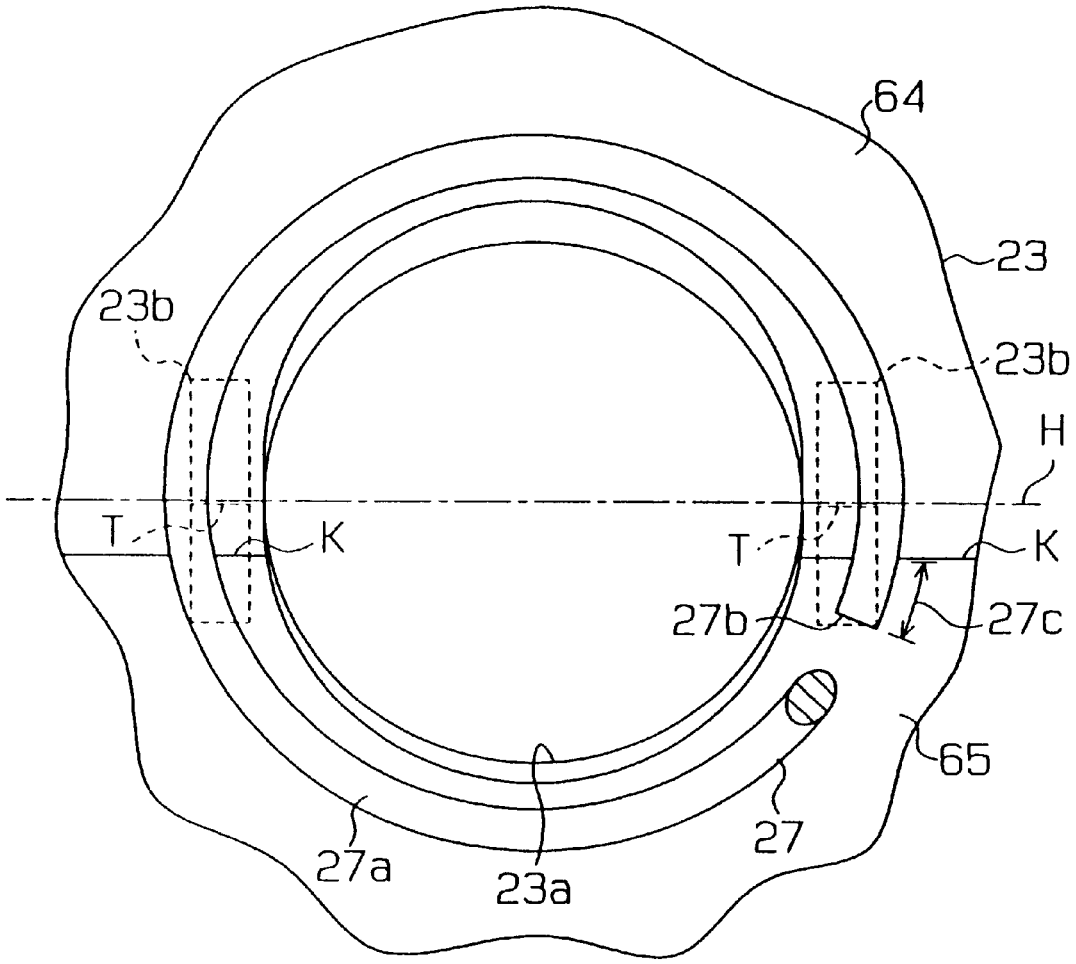
FIG. 8 is an enlarged partial view showing the vicinity of a central bore in the swash plate of the compressor of FIG. 7(*a*)
Figure 9A:
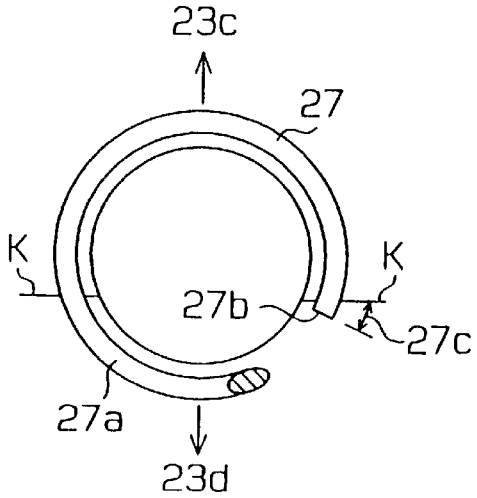
FIGS. 9(*a*), 9(*b*), 9(*c*), 9(*d*), 9(*e*), and 9(*f*) are diagrammatic views showing a spring arranged at different positions to urge the swash plate toward the minimum inclination position.
Figure 9B:
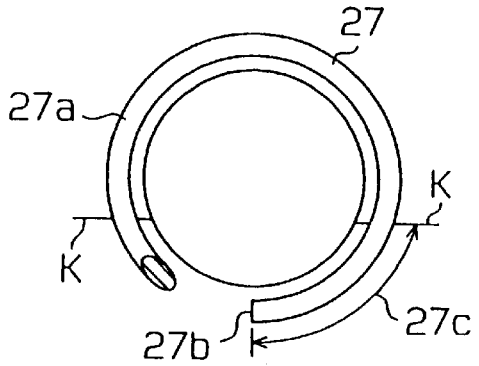
Figure 9C:
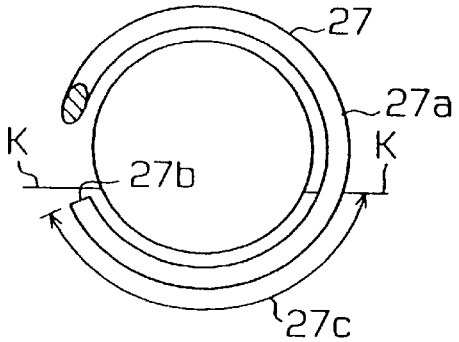
Figure 9D:
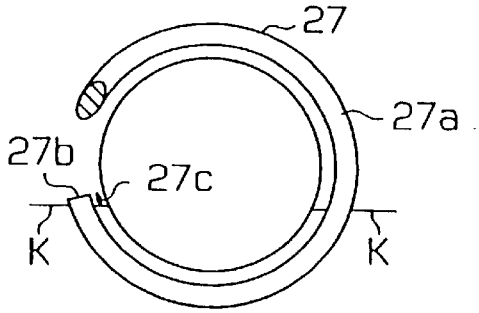
Figure 9E:
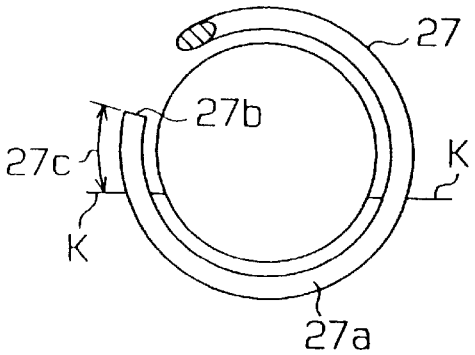
Figure 9F:
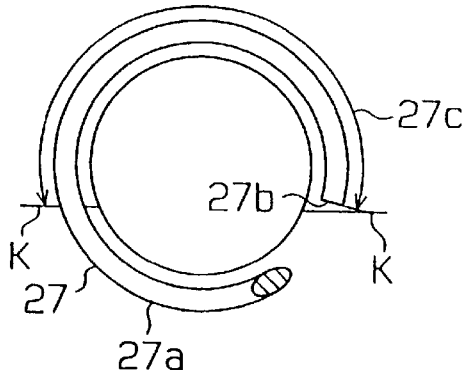
Figure 10:
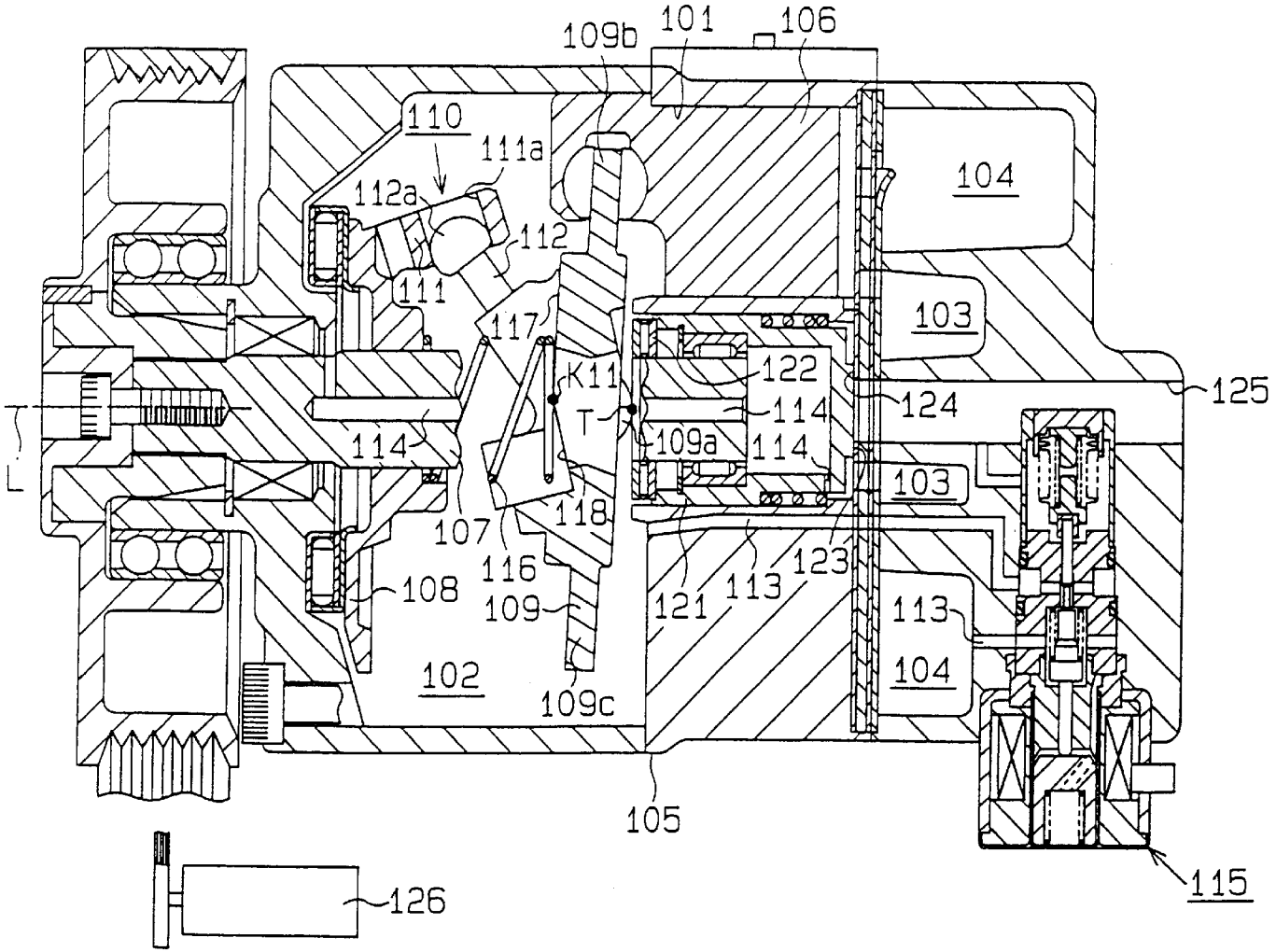
Fig.10 (Prior Art)
FIG. 10 is a cross-sectional view showing a prior art compressor in a minimum displacement state.
Figure 11:
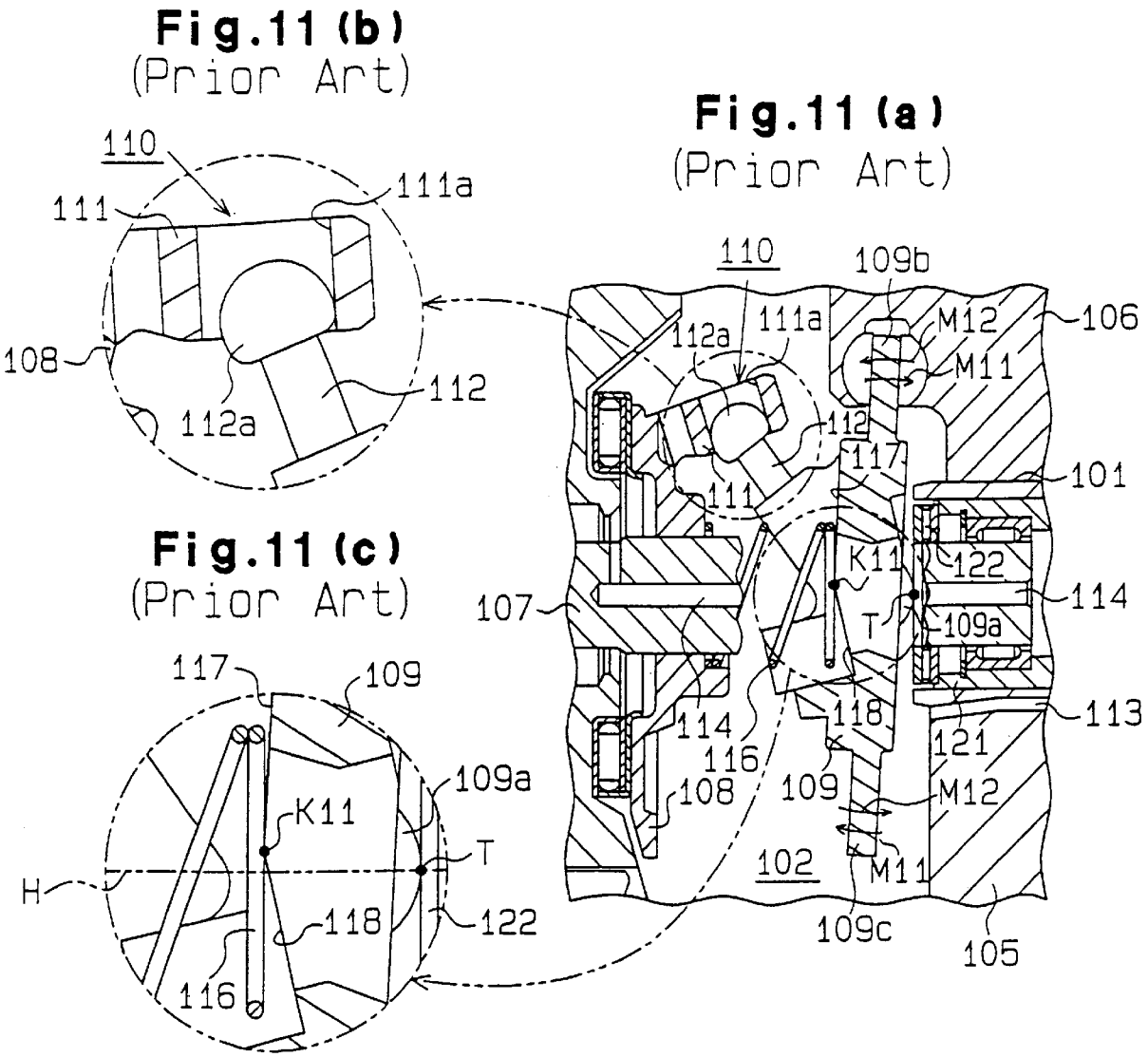
Fig.11 (a) (Prior Art)
Fig.11 (b) (Prior Art)
Fig.11 (c) (Prior Art)
FIGS. 11(*a*), 11(*b*), and 11(*c*) are partial cross-sectional views showing the compressor of FIG. 10.
Figure 12:
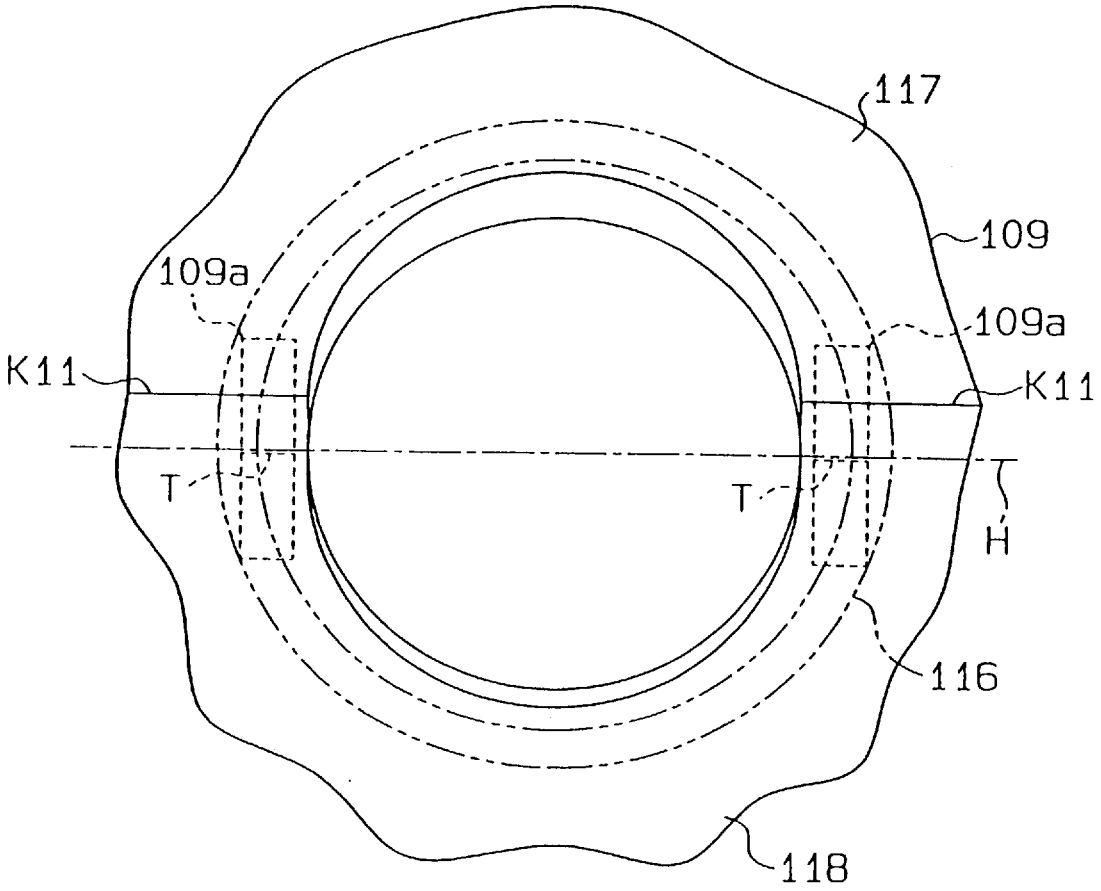
Fig.12 (Prior Art)
FIG. 12 is an enlarged partial view showing the vicinity of the central bore in the swash plate.

As shown in FIG. 8, in this embodiment, a portion of the first spring 27 is fixed to the drive shaft 16 so that when the swash plate 23 is located at the minimum inclination position, the location of the spring end 27*b* with respect to the ridge line K satisfies both of the above conditions. As a result, the position of the spring end 27*b* with respect to the ridge line K is maintained at an optimal location.

Figures 7A, 7B, 7C, 7D:
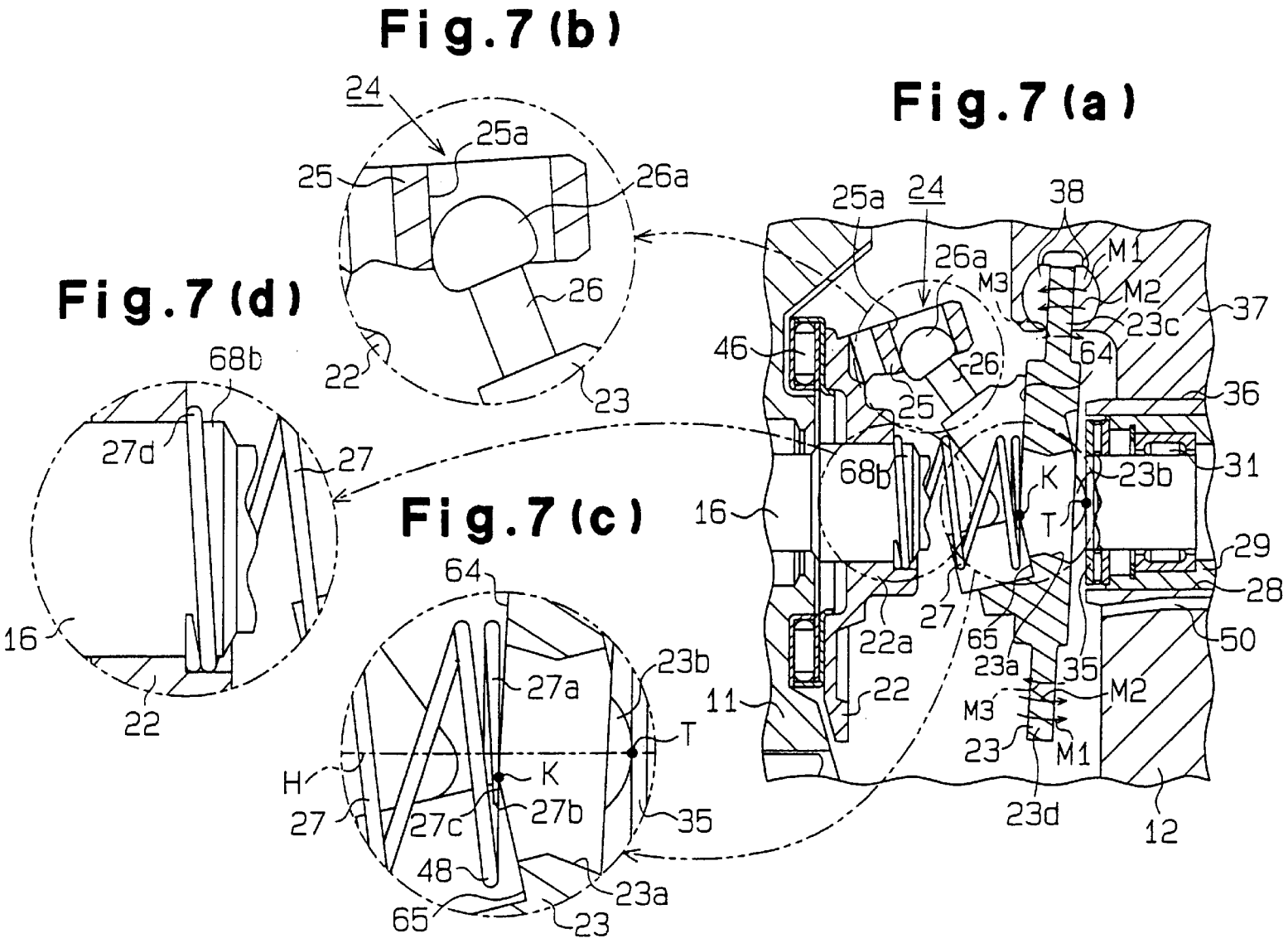
FIGS. 7(*a*), 7(*b*), 7(*c*), and 7(*d*) are partial cross-sectional views showing a further embodiment of a compressor according to the present invention.

As shown in FIG. 7(*d*), a spring seat 68*d* is defined between the rotor 22 and the swash plate 23 on the drive shaft 16 to hold the first spring 27. The diameter of the drive shaft 16 is enlarged at the spring seat 68*d* so that the first spring 27 is held fixed to the drive shaft 16. The large diameter portion may be formed by slightly extending the portion of the drive shaft 16 to which the rotor 22 is fixed. The first spring 27 has a first turn 27 that applies an appropriate pressure to the spring seat 68*d* when fitted thereon. This restricts relative rotation between the first spring 27 and the drive shaft 16.

Accordingly, each spherical portion 26*a* in the hinge mechanism 24 is effectively pressed against the rotor side of the associated guide bore 25*a* when the swash plate 23 is located at the minimum inclination position. Therefore, the inclination of the swash plate remains the same regardless of whether the compressor is in operation or not.

In this embodiment, when the swash plate 23 is arranged at the minimum inclination position, the ridge line K of the first and second planes 64, 65 is located at the BDC side of the hypothetical plane R. This results in the angle of the swash plate 23 at the minimum inclination position being the same regardless of whether the compressor is in operation or not. Since the setting of the minimum inclination is simplified, installation of the swash plate 23 is facilitated. This leads to reductions in costs required to produce the compressor. Furthermore, compressors having precise displacements are manufactured.

The first spring 27 is fixed to the drive shaft 16 to prevent relative rotation between the first spring 27 and the drive shaft 16. Accordingly, when the swash plate 23 is arranged at the minimum inclination position, the position of the spring end 27*b* with respect to the ridge line is positively maintained at the optimal location. This also contributes to the production of compressors having reduced costs and precise displacements.

The first spring 27 is pressed to the spring seat 68*d* and fixed to the drive shaft 16. Accordingly, installation of the first spring 27 is facilitated since special tools are not necessary.

This embodiment may be modified as described below.

A boss serving as a spring seat may be projected from the central rear surface of the rotor 22 about the drive shaft 16. The first spring 27 may be pressed onto and fixed to the peripheral surface of the boss.

An annular groove serving as a valve seat may be formed extending along the drive shaft 15 near the central rear surface of the rotor 22. The rotor side of the first spring 27 may be pressed into and fixed to the groove.

Figure 4:
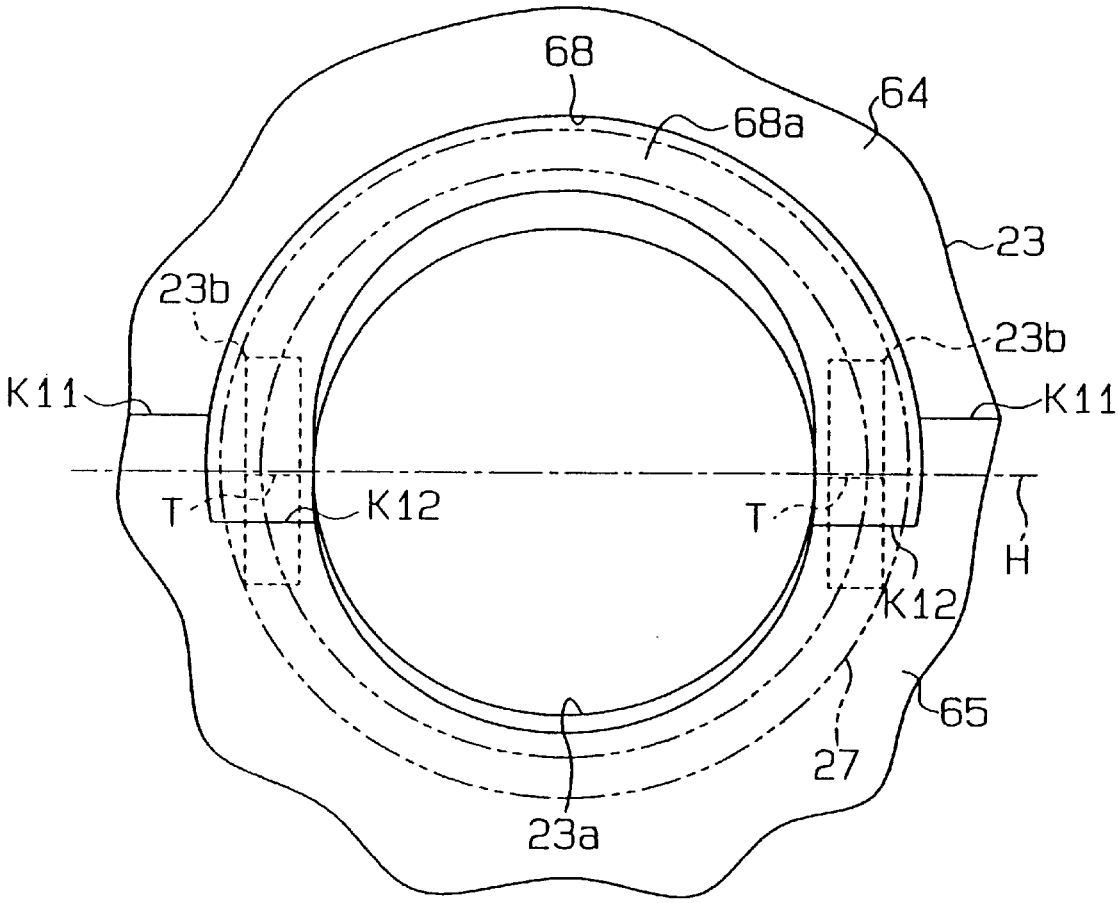
FIG. 4 is an enlarged partial view showing the vicinity of a central bore in a swash plate.

In the embodiment shown in FIG. 4, the ridge line K12 and the line T may be shifted toward the BDC portion 64 with their relative positions maintained. This structure also produces a moment acting in a direction that decreases the inclination of the swash plate 23.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement type compressor comprising:

a housing having a cylinder bore therein;

a piston located in the cylinder bore;

a drive shaft rotatably supported by the housing;

a rotary support mounted on the drive shaft;

a cam plate connected to the piston, wherein the cam plate is supported tiltably on the drive shaft and is slidable in axial directions of the drive shaft, wherein the cam plate inclines between a maximum inclination position and a minimum inclination position when the displacement of the compressor is changed;

a hinge mechanism located between the rotary support and the cam plate, wherein the hinge mechanism includes a first hinge part fixed to the cam plate and a second hinge part connected to the rotary support such that the first and second hinge parts engage with one another to form the hinge mechanism, and wherein a predetermined clearance exists between the first hinge part and the second hinge part, which permits a slight degree of slack in the movement of the cam plate in its inclining direction, and wherein the slack is taken up such that the hinge mechanism positively defines the angle of inclination of the swash plate when the cam plate is in its minimum inclination position while the compressor is running due to a first moment applied to the cam plate by a compression reaction force of the piston, and further wherein the cam plate rotates integrally with the drive shaft, the rotary support, and the hinge mechanism;

an urging means located between the rotary support and the cam plate for urging the cam plate toward the minimum inclination angle position; and means for applying a second moment to the swash plate in the same direction as the first moment when the compressor is not operating.

2. The compressor according to claim 1 further comprising a position restricting member that engages the cam plate to restrict the cam plate at the minimum inclination angle position.

3. The compressor according to claim 2, wherein the cam plate has a projection that engages the position restricting member, the projection having an arcuate surface.

4. The compressor according to claim 3, wherein the projection engages the position restricting member at a location that is substantially aligned with the axis of the drive shaft.

5. The compressor according to claim 4, wherein the cam plate includes:

a first section for positioning the piston at a top dead point in the cylinder bore; and a second section for positioning the piston at a bottom dead point in the cylinder bore;

wherein the urging means is a coil spring wound around the drive shaft, and wherein the spring engages the cam plate at a position offset toward the second section from a position where the projection engages the position restricting member to generate the second moment.

6. The compressor according to claim 5, wherein the cam plate has a seat for receiving and for positioning a part of the coil spring.

7. The compressor according to claim 6, wherein the cam plate comprises:

a peripheral section, wherein the peripheral section includes the first section and the second section;

a central section, wherein the central section receives the drive shaft, and wherein the central section has a first surface extending toward the center of the cam plate from the first section and a second surface extending toward the center of the cam plate from the second section, wherein the first surface and the second surface incline toward the rotary support to meet each other at a first ridge line.

8. The compressor according to claim 7, wherein the first ridge line is offset toward the first section from an imaginary plane containing the axis of the drive shaft.

9. The compressor according to claim 8, wherein the seat spans between the first surface and the second surface and forms a second ridge line in association with the second surface, wherein the second ridge line is offset toward the second section from the imaginary plane, and wherein the coil spring engages the second ridge line.

10. A variable displacement type compressor comprising:

a housing having a cylinder bore therein;

a piston located in the cylinder bore;

a drive shaft rotatably supported by the housing:

a rotary support mounted on the drive shaft;

a cam plate connected to the piston, wherein the cam plate is supported tiltably on the drive shaft and is slidable in axial directions of the drive shaft, wherein the cam plate inclines between a maximum inclination position and a minimum inclination position when the displacement of the compressor is changed;

a hinge mechanism located between the rotary support and the cam plate, wherein the hinge mechanism includes a first hinge part fixed to the cam plate and a second hinge part connected to the rotary support such that the first and second hinge parts engage with one another to form the hinge mechanism, and wherein a predetermined clearance exists between the first hinge part and the second hinge part, which permits a slight degree of slack in the movement of the cam plate in its inclining direction, and wherein the slack is taken up such that the hinge mechanism positively defines the angle of inclination of the swash plate when the cam plate is in its minimum inclination position while the compressor is running due to a first moment applied to the cam plate by a compression reaction force of the piston, and further wherein the cam plate rotates integrally with the drive shaft, the rotary support, and the hinge mechanism;

a spring wound around the drive shaft between the rotary support and the cam plate for urging the cam plate toward the minimum inclination angle position;

a rotation restricting means for restricting the rotation of the spring relative to the drive shaft; and a means for applying a second moment to the swash plate in the same direction as the first moment when the compressor is not operating.

11. The compressor according to claim 10, wherein the rotation restricting means includes a spring seat formed around the drive shaft, the spring being force-fitted to the spring seat.

12. The compressor according to claim 11 further comprising a position restricting member that engages the cam plate to restrict the cam plate at the minimum inclination angle position.

13. The compressor according to claim 12, wherein the cam plate has a projection that engages the position restricting member, the projection having an arcuate surface.

14. The compressor according to claim 13, wherein the projection engages the position restricting member at a location that is substantially aligned with the axis of the drive shaft.

15. The compressor according to claim 14, wherein the cam plate includes:

a first section for positioning the piston at a top dead point in the cylinder bore; and a second section for positioning the piston at a bottom dead point in the cylinder bore;

wherein the applying means comprises said spring, said spring being a coil spring wound around the drive shaft, and wherein the spring engages the cam plate at a position offset toward the second section from a position where the projection engages the position restricting member to generate the second moment.

16. The compressor according to claim 15, wherein the cam plate comprises:

a peripheral section, wherein the peripheral section includes the first section and the second section;

a central section, wherein the central section receives the drive shaft, and wherein the central section has a first surface extending toward the center of the cam plate from the first section and a second surface extending toward the center of the cam plate from the second section, wherein the first surface and the second surface incline toward the rotary support to meet each other at a first ridge line.

17. The compressor according to claim 16, wherein the first ridge line is offset toward the first section from an imaginary plane containing the axis of the drive shaft.

18. The compressor according to claim 17, wherein the spring has a free end that is located at a position that is offset from the first ridge line toward the second section.

19. A variable displacement type compressor comprising:

a housing having a cylinder bore therein;

a piston located in the cylinder bore;

a drive shaft rotatably supported by the housing;

a rotary support mounted on the drive shaft;

a cam plate connected to the piston, wherein the cam plate is supported tiltably on the drive shaft and is movable in axial directions of the drive shaft, wherein the cam plate inclines between a maximum inclination position and a minimum inclination position when the displacement of the compressor is changed;

a hinge mechanism formed by the rotary support and the cam plate, wherein the hinge mechanism includes a first hinge part fixed to the cam plate and a second hinge part connected to the rotary support such that the first and second hinge parts engage with one another to form the hinge mechanism, and wherein a predetermined clearance exists between the first hinge part and the second hinge part, which permits a slight degree of slack in the movement of the cam plate in its inclining direction, and wherein the slack is taken up such that the hinge mechanism positively defines the angle of inclination of the swash plate when the cam plate is in its minimum inclination position while the compressor is running due to a first moment applied to the cam plate by a compression reaction force of the piston, and further wherein the cam plate rotates integrally with the drive shaft, the rotary support, and the hinge mechanism;

a spring located between the rotary support and the cam plate for urging the cam plate toward the minimum inclination angle position, wherein the spring is constructed and arranged to apply a spring force to the cam plate, and wherein the spring force causes the application of a second moment to the swash plate, wherein the second moment acts in a direction to urge the first hinge part toward the rotary support such that there is no slack in the hinge mechanism when the compressor is at rest.

20. The compressor according to claim 19 further comprising a position restricting member that engages the cam plate to restrict the cam plate at the minimum inclination angle position, wherein the cam plate has a projection that engages the position restricting member, wherein the location of engagement between the projection and the restricting member is offset from the location of the spring force, which produces the second moment.

* * * * *